US011791544B2

(12) United States Patent
Rogers

(10) Patent No.: US 11,791,544 B2
(45) Date of Patent: Oct. 17, 2023

(54) HIGH GAIN STRIPLINE ANTENNA ASSEMBLIES

(71) Applicant: THE BOEING COMPANY, Chicago, IL (US)

(72) Inventor: John E. Rogers, Huntsville, AL (US)

(73) Assignee: THE BOEING COMPANY, Chicago, IL (US)

( * ) Notice: Subject to any disclaimer, the term of this patent is extended or adjusted under 35 U.S.C. 154(b) by 111 days.

(21) Appl. No.: 17/554,016

(22) Filed: Dec. 17, 2021

(65) Prior Publication Data

US 2022/0216603 A1 Jul. 7, 2022

Related U.S. Application Data

(60) Provisional application No. 63/133,306, filed on Jan. 2, 2021.

(51) Int. Cl.

| | |
|---|---|
| ***H01Q 1/38*** | (2006.01) |
| ***H01Q 21/00*** | (2006.01) |
| *H01Q 1/28* | (2006.01) |

(52) U.S. Cl.

CPC ..... *H01Q 1/38* (2013.01); *H01Q 21/0075* (2013.01); *H01Q 1/286* (2013.01)

(58) Field of Classification Search

CPC ..... H01Q 1/422; H01Q 1/38; H01Q 19/005; H01Q 21/0075; H01Q 1/523; H01Q 21/065; H01Q 9/0457; H01Q 1/286

See application file for complete search history.

(56) References Cited

U.S. PATENT DOCUMENTS

| | | | | |
|---|---|---|---|---|
| 4,843,400 | A * | 6/1989 | Tsao | H01Q 21/065 343/700 MS |
| 2019/0312358 | A1* | 10/2019 | Rogers | H01P 3/081 |
| 2020/0099420 | A1 | 3/2020 | Rogers | |

OTHER PUBLICATIONS

Pozar, D.M., "Microstrip antenna aperture-coupled to a microstrip line," Electronics Letters, Jan. 1985.

(Continued)

*Primary Examiner* — David E Lotter

(74) *Attorney, Agent, or Firm* — The Small Patent Law Group LLC; Joseph M. Butscher

(57) ABSTRACT

An antenna assembly includes one or more dielectrics having a first surface and a second surface opposite from the first surface. An antenna layer includes one or more antenna elements disposed on the first surface of the one or more dielectrics. A stripline feed network is disposed on or within the one or more dielectrics. One or more cavities are formed in the one or more dielectrics. The one or more cavities are disposed below the one more antenna elements.

20 Claims, 5 Drawing Sheets

(56) References Cited

OTHER PUBLICATIONS

Pozar, D.M. Kaufman, B. "Increasing the bandwidth of a microstrip antenna by proximity coupling," Electronics Letters, Apr. 1987.
Iwskai, H. "A circularly polarized small-size microstrip antenna with a cross slot," IEEE Transactions on Antennas and Propagation, Oct. 1996.
Papapolymerou, I., "Micromachined patch antennas," IEEE Transactions on Antennas and Propagation, Feb. 1998.
Gauthier, G.P., "A 94 GHz aperture-coupled micromachined microstrip antenna," IEEE Transactions on Antennas and Propagation, Dec. 1999.
Cook, B.S., "Multilayer inkjet printing of millimeter-wave proximity-fed patch arrays on flexible substrates," IEEE Antennas and Wireless Propagation Letters, Oct. 2013.
Sorkerizi, M.S., "Planar high-efficiency antenna array using new printed ridge gap waveguide technology," IEEE Transactions on Antennas and Propagation, Jul. 2017.

* cited by examiner

HIGH GAIN STRIPLINE ANTENNA ASSEMBLIES

RELATED APPLICATIONS

This application relates to and claims priority benefits from U.S. Provisional Patent Application No. 63/133,306, entitled "High Gain Stripline Antenna Assemblies," filed Jan. 2, 2021, which is hereby incorporated by reference in its entirety.

FIELD OF EMBODIMENTS OF THE DISCLOSURE

Embodiments of the present disclosure generally relate to antenna assemblies, and more particularly, to stripline-based antenna assemblies.

BACKGROUND OF THE DISCLOSURE

An antenna typically includes an array of conductors electrically connected to an electronic receiver or a transmitter. An electronic transmitter provides a time-varying voltage to terminals of the antenna, which, in response, radiates electromagnetic radio waves at a frequency corresponding to the time-varying voltage. Alternatively, as radio waves are received by the antenna, a time-varying voltage corresponding to the frequency of the radio wave is generated at the terminals, which, in turn is provided to the electronic receiver. Various types of known passive antennas are configured to transmit and receive radio waves equivalently with such a reciprocal behavior.

In some aerospace applications, there is a need for antennas that are capable of being positioned on conformal or non-planar surfaces, such as wings and fuselages of aircraft. Small aircraft, such as unmanned aerial vehicles (UAVs) or drones, in particular, have surfaces with low radii of curvature. Such aircraft typically need light weight antennas with low aerodynamic drag and low visibility. Further, various surfaces of aircraft may be formed from conductive or carbon fiber materials, which are known to change the electrical behavior of antennas, such as monopole and dipole antennas and derivatives (for example, whip, blade, Yagi, and other such antennas).

Various known planar antennas that include microstrip feeds and pin feeds exhibit low bandwidth, due to their narrowband impedance matching. However, the bandwidth can be increased by using a proximity-coupled feed line. Still, planar antennas generally have low gain and bandwidth due to their thin nature.

SUMMARY OF THE DISCLOSURE

A need exists for a stripline-based antenna that exhibits increased or otherwise improved gain and bandwidth.

With that need in mind, certain embodiments of the present disclosure provide an antenna assembly including one or more dielectrics having a first surface and a second surface opposite from the first surface. An antenna layer includes one or more antenna elements disposed on the first surface of the one or more dielectrics. A stripline feed network is disposed on or within the one or more dielectrics. One or more cavities are formed in the one or more dielectrics. The one or more cavities are disposed below the one more antenna elements.

In at least one embodiment, the antenna layer further includes one or more coplanar ground elements separated from the one or more antenna elements. As a further example, one or more vias connect the one or more coplanar ground elements to a ground plane disposed below the one or more dielectrics.

In at least one embodiment, a ground plane is disposed below the one or more dielectrics. As a further example, at least one additional dielectric is disposed below the ground plane.

The one or more antenna elements may include an inclusive slot.

In at least one embodiment, the one or more cavities are between the first surface and the second surface.

In at least one embodiment, the one or more antenna elements are above the one or more cavities.

In at least one example, at least a portion of the stripline feed network is disposed between the one or more antenna elements and the one or more cavities.

As an example, the one or more dielectrics include a first dielectric having the first surface. A second dielectric is secured to the first dielectric. The second dielectric is disposed between the first dielectric and at least a portion of the stripline feed network. A third dielectric includes the one or more cavities and the second surface. The at least a portion of the stripline feed network is disposed between the second dielectric and the third dielectric.

In at least one embodiment, a first diameter or axial envelope of the one or more antenna elements is within a second diameter or axial envelope of the one or more cavities.

As an example, the one or more antenna elements include at least two antenna elements. The one or more cavities include at least two cavities.

Certain embodiments of the present disclosure provide a method of forming an antenna assembly. The method includes providing one or more dielectrics having a first surface and a second surface opposite from the first surface; disposing an antenna layer including one or more antenna elements on the first surface of the one or more dielectrics; disposing a stripline feed network on or within the one or more dielectrics; and forming one or more cavities in the one or more dielectrics below the one more antenna elements.

In at least one embodiment, the method also includes providing the antenna layer with one or more coplanar ground elements separated from the one or more antenna elements. The method may further include connecting the one or more coplanar ground elements to a ground plane disposed below the one or more dielectrics with one or more vias.

In at least one embodiment, the method includes disposing a ground plane below the one or more dielectrics. The method may further include disposing at least one additional dielectric below the ground plane.

In at least one embodiment, said forming includes forming the one or more cavities between the first surface and the second surface.

In at least one embodiment, the method further includes disposing at least a portion of the stripline feed network between the one or more antenna elements and the one or more cavities.

DETAILED DESCRIPTION OF THE DISCLOSURE

The foregoing summary, as well as the following detailed description of certain embodiments, will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Certain embodiments of the present disclosure provide a stripline-based antenna assembly that exhibits improved gain as compared to known stripline antennas. The antenna assembly includes at least one proximity-coupled antenna element with an inclusive slot and a coplanar ground plane on a first surface of one or more dielectrics, such as a radio frequency (RF) board. An embedded stripline feed is below the stripline feed antenna element, a ground plane below the stripline feed, and a cavity between the stripline feed antenna element and ground plane. The slot and coplanar ground improve the cross polarization of the antenna. The stripline feed minimizes or otherwise reduces power loss in the feed network (in comparison to microstrip and grounded coplanar waveguide feeds). Further, the ground plane minimizes or otherwise reduces any change in electrical behavior when the antenna assembly is placed on conductive surfaces (for example, wings, fuselage, tail fin, and/or the like).

The antenna assemblies according to embodiments of the present disclosure includes one or more antenna elements and coplanar ground elements electrically coupled to a stripline feed. A stripline feed minimizes or otherwise reduces power loss through the feed network. A cavity between the antenna element(s) and backside ground plane improves gain of the antenna assembly. The backside ground plane minimizes or otherwise reduces change in electrical behavior due to conductive surfaces. The antenna assemblies can be manufactured using subtractive (for example, laser etching, milling, wet etching, or the like) or additive (for example, printing, film deposition, or the like) methods.

Figure 1:
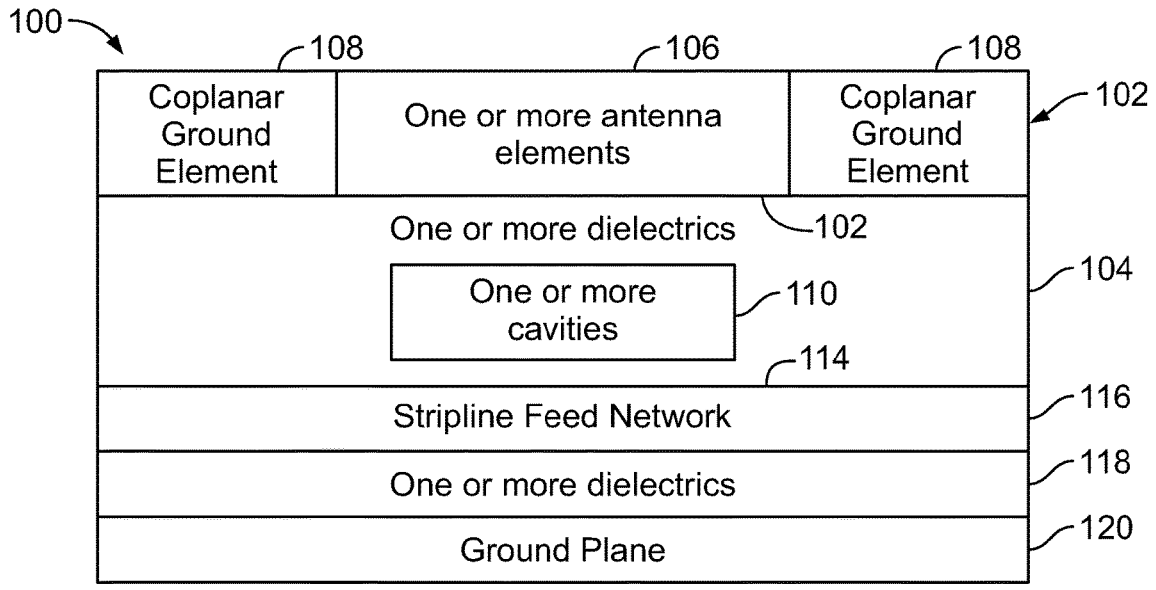
FIG. 1 illustrates a schematic block diagram of an antenna assembly, according to an embodiment of the present disclosure.

FIG. 1 illustrates a schematic block diagram of an antenna assembly 100, according to an embodiment of the present disclosure. The antenna assembly includes an antenna layer 102 disposed on one or more dielectrics 104, such as one or more dielectric layers. The antenna layer 102 includes one or more antenna elements 106 separated from coplanar ground elements 108. That is, the antenna element(s) 106 are coplanar with the ground elements 108 within the antenna layer 102.

In at least one embodiment, the antenna element(s) is proximity coupled (or electrically coupled), and includes an inclusive slot. The inclusive slot and coplanar ground elements 108 improve cross polarization of the antenna assembly 100. The one or more dielectrics 104 may form at least part of an RF board.

A stripline feed network 116 is disposed under or within the one or more dielectrics 104. For example, the stripline feed network 116 is disposed underneath the one or more dielectrics 104. As another example, the stripline feed network 116 is sandwiched between two different dielectrics 104. The stripline feed network 116 minimizes or otherwise reduces power loss (as compared to microstrip and grounded coplanar waveguide feeds).

One or more dielectrics 118 can be disposed underneath the stripline feed network 116. For example, the stripline feed network 116 can be sandwiched between the one or more dielectrics 104 and the one or more dielectrics 118.

In at least one embodiment, one or more cavities 110 (for example, air gaps) are formed in the one or more dielectrics 104. The one or more cavities 110 are aligned with the one or more antenna elements 106. For example, the one or more antenna elements 106 are disposed on a first surface 112, such as an upper surface, of the one or more dielectrics 104 that is opposite a second surface 114, such as a lower surface. The one or more cavities 110 are between the first surface 112 and the second surface 114. In at least one embodiment, the antenna element(s) 106 are above the one or more cavities 110. The antenna element(s) 106 are not within the one or more cavities 110. Instead, the antenna element(s) 106 are aligned over, above, or the like from the one or more cavities 110. In at least one embodiment, the antenna element(s) 106 are secured on the first surface 112 and axially aligned over the one or more cavities 110.

In at least one embodiment, the one or more cavities 110 are disposed between the stripline feed network and the one or more antenna elements 106. In at least one embodiment, the one or more cavities 110 are above the stripline feed network 116. In at least one embodiment, a first cavity 110 is above the stripline feed network 116, and a second cavity 110 is below the stripline feed network 116.

A ground plane 120 is disposed below the one or more dielectrics 118. Optionally, the ground plane 120 can be secured to the one or more dielectrics 104, and the one or more dielectrics 118 can be secured underneath the ground plane 120. For example, the ground plane 120 can be sandwiched between the one or more dielectrics 104 and the one or more dielectrics 118. Optionally, the antenna assembly 100 may not include the one or more dielectrics 118. Instead, the ground plane 120 may be secured to the stripline feed network 116 and/or the second surface 114 of the one or more dielectrics 104 (such as when the stripline feed network 116 is disposed within the one or more dielectrics 104). The ground plane 120 minimizes or otherwise reduces any change in electrical behavior when the antenna assembly 100 is placed on conductive surfaces (for example, wings, fuselage, tail fin, and/or the like).

In at least one embodiment, one or more vias connect the coplanar ground elements 108 to the ground plane 120. For example, each coplanar ground elements 108 connects to the ground plane 120 through a separate via.

The one or more cavities 110 between the antenna element(s) 106 and ground plane 120 improve gain of the antenna assembly 100. It has been found that the antenna assembly 100 exhibits improved gain as compared to known stripline antennas.

As described herein, the antenna assembly 100 includes one or more dielectrics 104 having the first surface 112 and the second surface 114 opposite from the first surface 112. The antenna layers 102 includes one or more antenna elements 106 disposed on the first surface 112 of the one or more dielectrics 104. The stripline feed network 116 is secured on, within, or below the one or more dielectrics 104. In at least one embodiment, the stripline feed network 116 is below the one or more antenna elements 106. One or more dielectrics 118 are secured below the stripline feed network 116. The one or more cavities 110 are formed in the one or more dielectrics 118. The one or more cavities 110 are disposed below the one more antenna elements 106.

Figure 2:
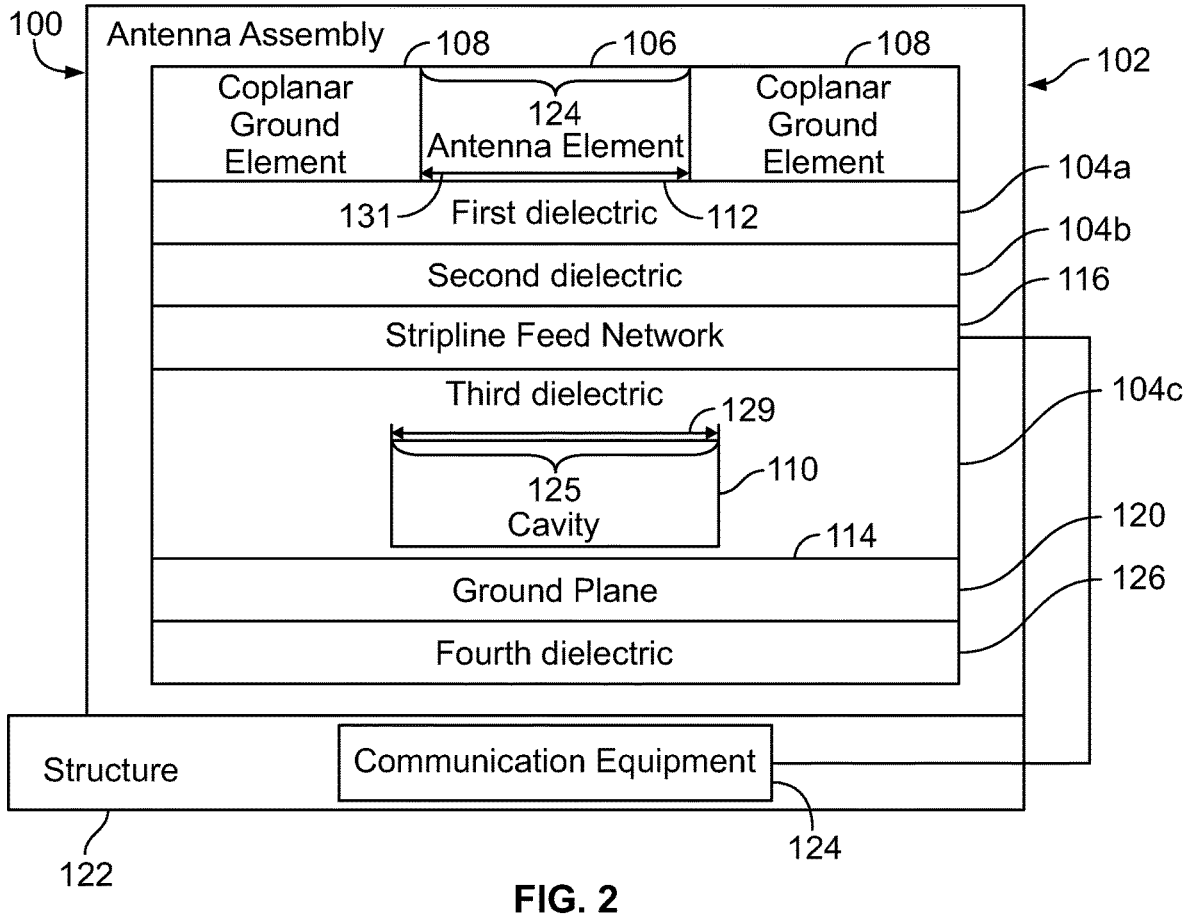
FIG. 2 illustrates a schematic block diagram of the antenna assembly secured to a structure, according to an embodiment of the present disclosure.

FIG. 2 illustrates a schematic block diagram of the antenna assembly 100 secured to a structure 122, according to an embodiment of the present disclosure. For example, the structure 122 is a portion of a body of an aircraft. In at least one embodiment, the structure 122 is a wing, fuselage, tail fine, or the like of an aircraft. The structure 122 includes communication equipment or electronics 124 that connect to the stripline feed network 116, such as through a microstrip.

As shown, the antenna layer 102 is disposed on the first surface 112 of a first dielectric 104*a*. A second dielectric 104*b* separates the first dielectric 104*a* from the stripline feed network 116. The stripline feed network 116 is disposed between the second dielectric 104*b* and a third dielectric 104*c*. A cavity 110 is formed within the third dielectric 104*c*. The cavity 110 is underneath the antenna element 106. In at least one embodiment, the cavity 110 is directly underneath the antenna element 106. The cavity 110 may have a diameter or width 125 that exceeds the diameter or width 127 of the antenna element 106. Accordingly, the axial envelope 129 of the cavity 110 is greater than the axial envelope 131 of the antenna element 106. In at least one embodiment, the axial envelope 131 of the antenna element 106 does not extend past the axial envelope 129 of the cavity 110. Accordingly, the axial envelope 131 of the antenna element 106 is within the axial envelope 129 of the cavity 110.

The ground plane 120 is disposed underneath the third dielectric 104*c*. For example, the ground plane 120 is secured to the second surface 114 of the third dielectric 104*c*.

As shown in FIG. 2, the first dielectric 104*a* has the first surface 112. The second dielectric 104*b* is secured to the first dielectric 104*a*. The second dielectric 104*b* is disposed between the first dielectric 104*a* and at least a portion of the stripline feed network 116. The third dielectric 104*c* includes the cavity 110, and the second surface 114. The at least a portion of the stripline feed network 116 is disposed between the second dielectric 104*b* and the third dielectric 104*c*.

In at least one embodiment, a fourth dielectric 126 is disposed between the structure 122 and the ground plane 120. The fourth dielectric 126 can be mounted directly to the structure 122. Alternatively, the antenna assembly 100 does not include the fourth dielectric 126.

The antenna assembly 100 can include more or less dielectrics than shown. For example, the antenna assembly 100 may not include the second dielectric 104*b*.

Further, the antenna assembly 100 can include more antenna elements 106 than shown. As an example, antenna assembly 100 can include two, three, four, or more antenna elements 106 above one or more cavities 110. In at least one embodiment, a single cavity 110 is disposed underneath multiple antenna elements 106. In at least one other embodiment, each antenna element 106 is disposed above a separate and distinct cavity 110. For example, the antenna assembly 100 can include two or more antenna elements 106 disposed above two or more cavities 110, with each antenna element 106 disposed over a separate cavity 110.

It is to be understood that the terms first, second, third, fourth, and the like are merely for labeling purposes. A "first," may be a "second," "third," "fourth," or vice versa.

Figure 3:
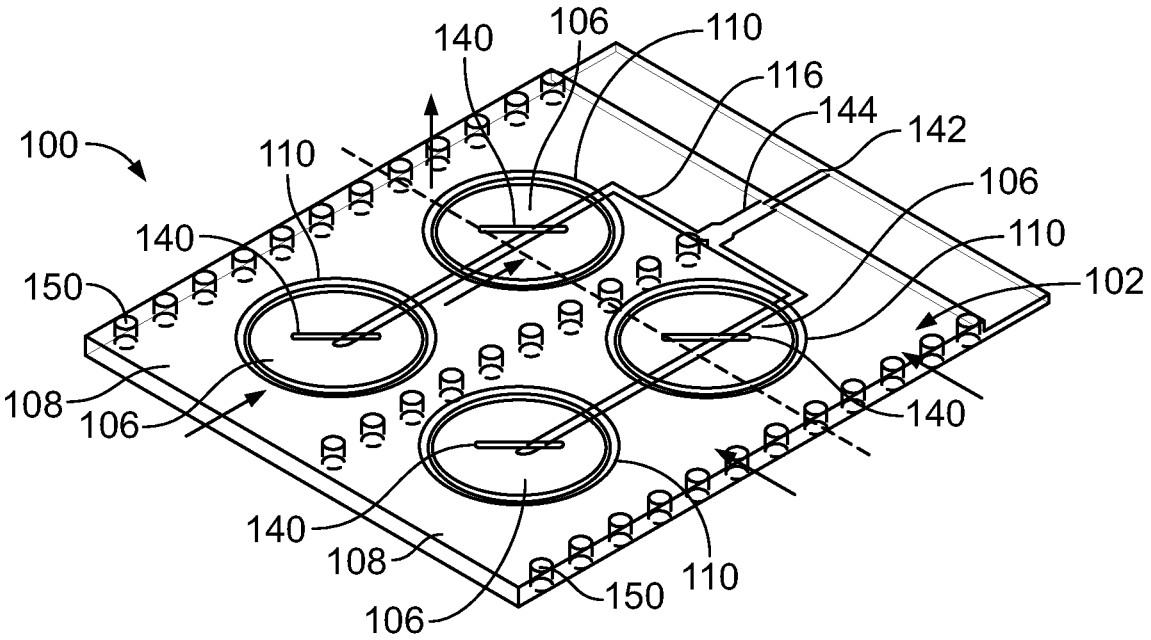
FIG. 3 illustrates a perspective top view of the antenna assembly, according to an embodiment of the present disclosure.
Figure 4:
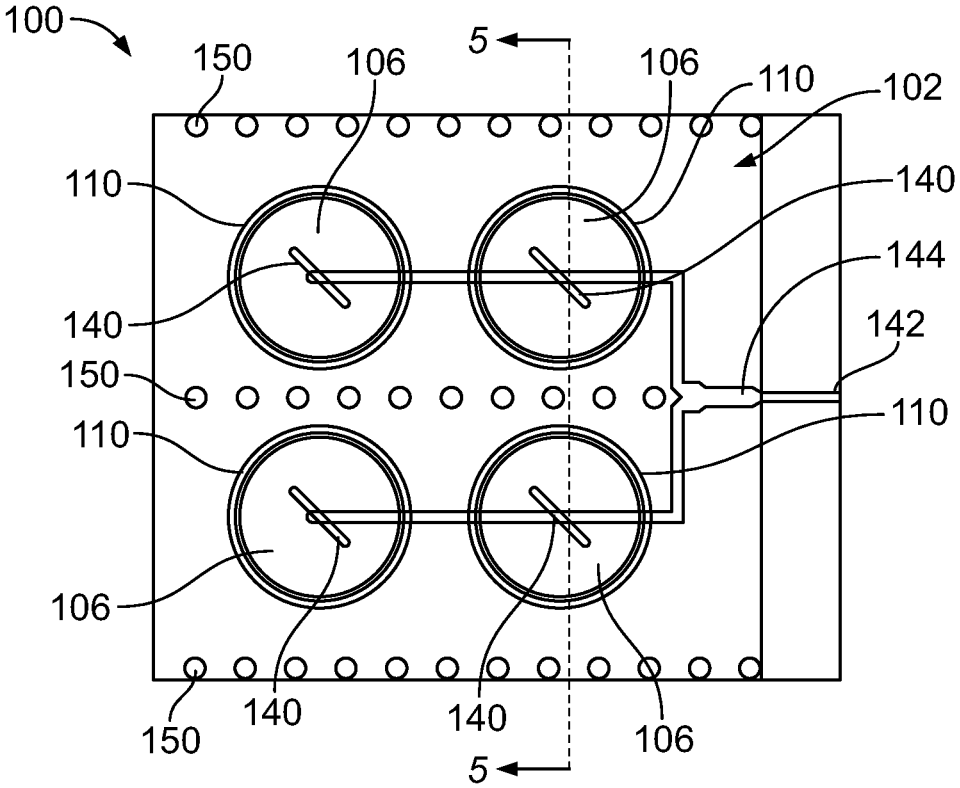
FIG. 4 illustrates a top view of the antenna assembly of FIG. 3.

FIG. 3 illustrates a perspective top view of the antenna assembly 100, according to an embodiment of the present disclosure. FIG. 4 illustrates a top view of the antenna assembly 100 of FIG. 3. Referring to FIGS. 3 and 4, for the sake of clarity, portions of the antenna assembly 100 are shown transparent.

As shown, the antenna assembly 100 includes four antenna elements 106 disposed above four cavities 110, respectively. Optionally, the antenna assembly 100 can include more or less antenna elements 106 disposed above more or less cavities 110. The antenna elements 106 are not within the cavities 110. Rather, the antenna elements 106 are disposed above the cavities 110, as described above.

The antenna elements 106 can include inclusive slots 140, which improve cross polarization of the antenna assembly 100. Optionally, less than all of the antenna elements 106 include inclusive slots 140. Alternatively, none of the antenna elements 106 include inclusive slots 140.

A microstrip 142 (such as a conductor and ground plane) connects a power divider 144, such as in an edge-to-edge fashion. The power divider 144 in turn connects to, or optionally forms part of, the stripline feed network 116, which couples to the antenna elements 106, such as via proximity coupling. Electrical vias 150 connect the coplanar ground elements 108 of the antenna layer 102 to the ground plane 120 (shown in FIGS. 1 and 2). In at least one embodiment, the cavities 110 (or additional cavities) can extend below and/or above portions of the stripline feed network 116 outside of the diameters or axial envelopes of the antenna elements 106. For example, cavities 110 may extend below and/or above an entirety of the stripline feed network 116.

Figure 5:
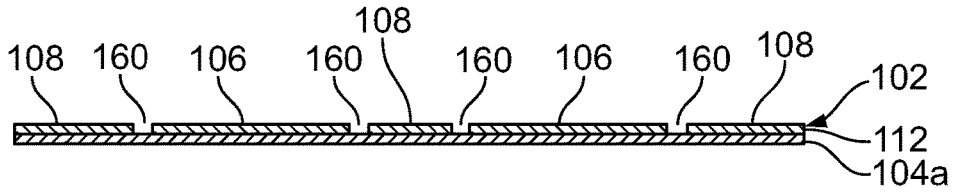
FIG. 5 illustrates a cross-sectional view of an antenna layer disposed on a first dielectric through line 5-5 of FIG. 4, according to an embodiment of the present disclosure.

FIG. 5 illustrates a cross-sectional view of the antenna layer 102 disposed on the first dielectric 104*a* through line 5-5 of FIG. 4, according to an embodiment of the present disclosure. The coplanar ground elements 108 are separated from the antenna elements 106 by gaps 160, thereby electrically isolating the coplanar ground elements 108 from the antenna elements 106. In at least one embodiment, a metal, such as copper, can be deposited or printed onto the first dielectric 104*a* (such as the first or upper surface 112) to form the antenna elements 106 and the coplanar ground elements 108.

Figure 6:
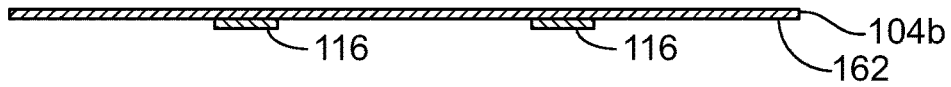
FIG. 6 illustrates a cross-sectional view of a stripline feed network disposed underneath a second dielectric through line 5-5 of FIG. 4, according to an embodiment of the present disclosure.

FIG. 6 illustrates a cross-sectional view of the stripline feed network 116 disposed underneath the second dielectric 104*b* through line 5-5 of FIG. 4, according to an embodiment of the present disclosure. In at least one embodiment, a metal, such as copper, can be deposited or printed onto a lower or bottom surface 162 of the second dielectric 104*b* to form the stripline feed network 116.

Figure 7:
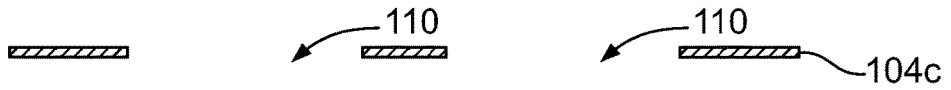
FIG. 7 illustrates a cross-sectional view of cavities formed within a third dielectric through line 5-5 of FIG. 4, according to an embodiment of the present disclosure.

FIG. 7 illustrates a cross-sectional view of the cavities 110 formed within the third dielectric 104*c* through line 5-5 of FIG. 4, according to an embodiment of the present disclosure. In at least one embodiment, the cavities 110 may be etched into the third dielectric 104*c*. The cavities 110 may extend between and through upper and lower surfaces of the third dielectric 104*c*.

Figure 8:
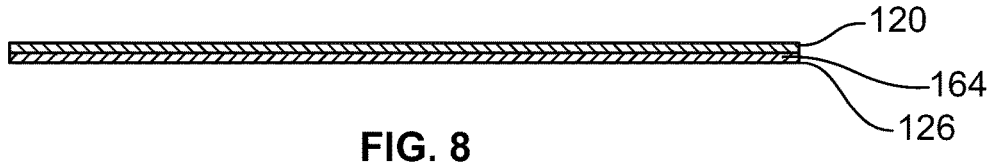
FIG. 8 illustrates a cross-sectional view of a ground plane disposed over a fourth dielectric through line 5-5 of FIG. 4, according to an embodiment of the present disclosure.

FIG. 8 illustrates a cross-sectional view of the ground plane 120 disposed over the fourth dielectric 126 through line 5-5 of FIG. 4, according to an embodiment of the present disclosure. In at least one embodiment, a metal, such as copper, can be deposited or printed onto an upper surface 164 of the fourth dielectric 126 to form the ground plane 120.

Figure 9:
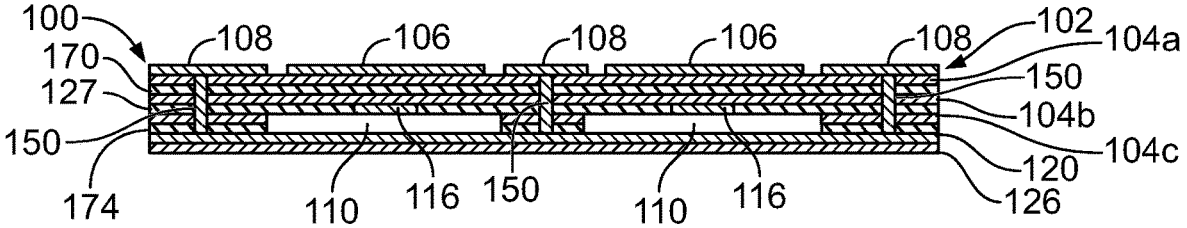
FIG. 9 illustrates a cross-sectional view of the antenna assembly through line 5-5 of FIG. 4.

FIG. 9 illustrates a cross-sectional view of the antenna assembly 100 through line 5-5 of FIG. 4. Laminate layers 170, 172, and 174 may be used to secure the various layers of the antenna assembly 100 together. The vias 150 can be formed by etching and filling with conductive ink or electroplating. The vias 150 electrically connect the coplanar ground elements 108 with the ground plane 120. As shown in FIG. 9, at least a portion of the stripline feed network 116 is disposed between the antenna elements 106 and the cavities 110.

Figure 10:
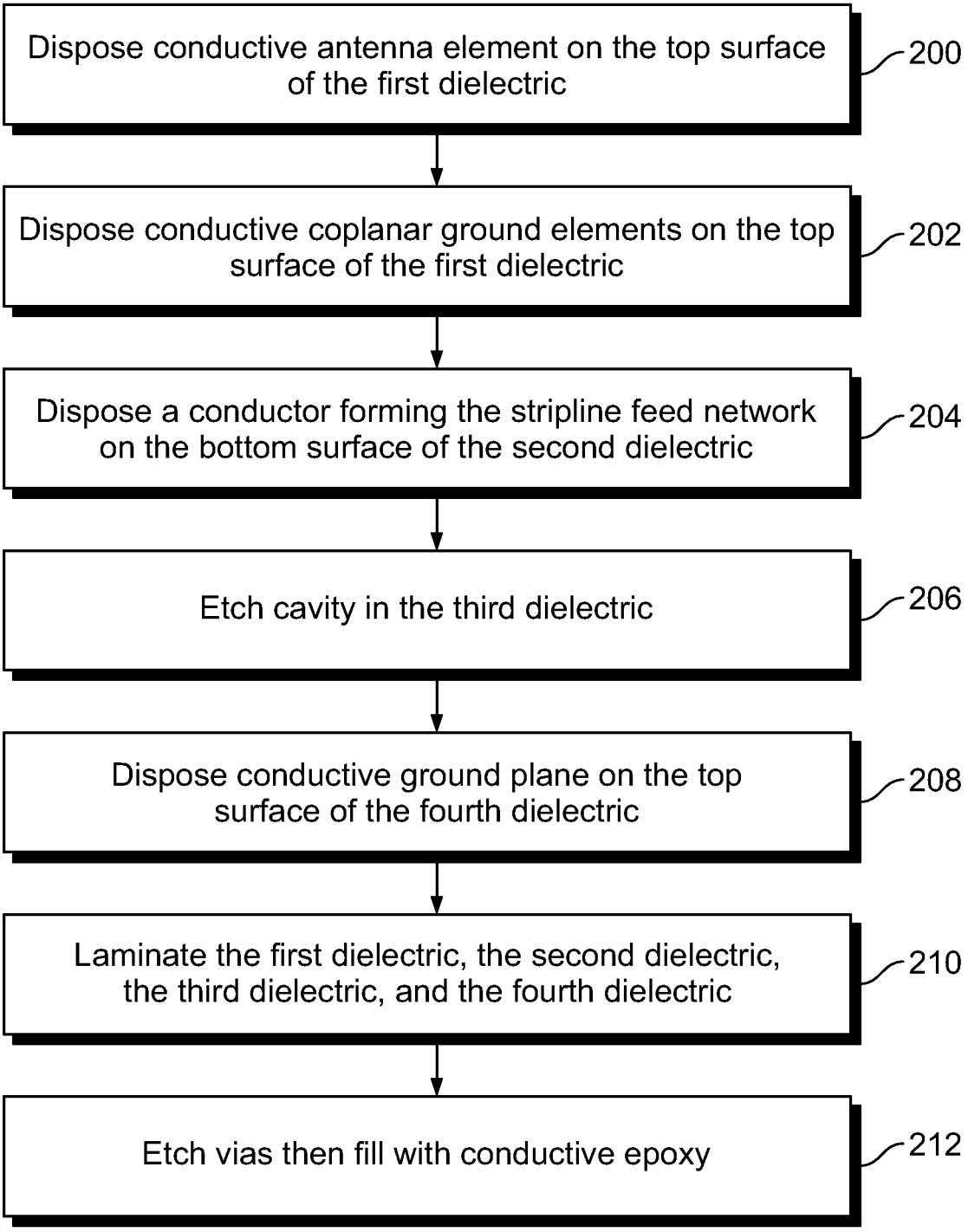
FIG. 10 illustrates a flow chart of a method of forming an antenna assembly, according to an embodiment of the present disclosure.

FIG. 10 illustrates a flow chart of a method of forming an antenna assembly, according to an embodiment of the present disclosure. Referring to FIGS. 2-10, at 200, the antenna elements 106 are disposed on a top surface (such as the first surface 112) of the first dielectric 104*a*. At 202, the coplanar ground elements 108 are disposed on the top surface of the first dielectric 104*a*. At 204, a conductor forming the stripline feed network 116 is disposed on the bottom surface 162 of the second dielectric 104*b*. At 206, the cavities 110 are etched into the third dielectric 104*c*. At 208, the ground plane 120 is disposed on the upper or top surface 164 of the fourth dielectric 126. At 210, the first dielectric 104*a*, the second dielectric 104*b*, the third dielectric 104*c*, and the fourth dielectric 104*c* are laminated together. At 212, the vias 150 are etched and filled with conductive epoxy.

Figure 11:
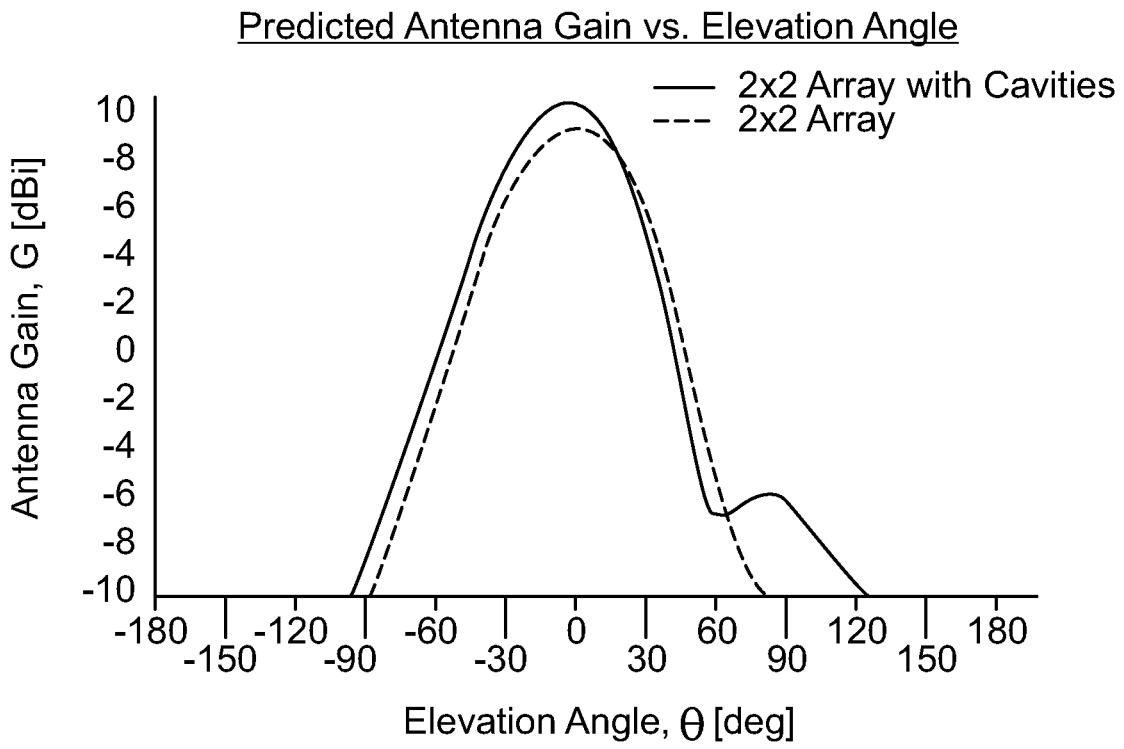
FIG. 11 illustrates a graph of predicted gain in relation to elevation angle for an antenna assembly having cavities, as described herein, compared to an antenna assembly without cavities.
Figure 12:
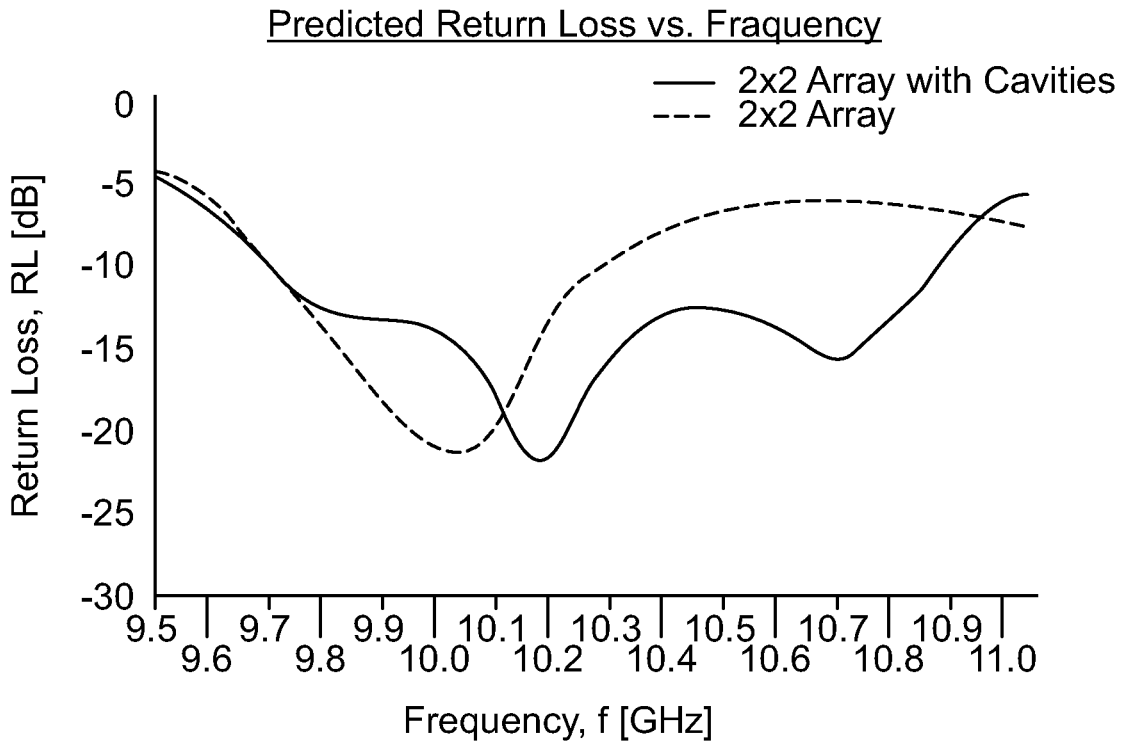
FIG. 12 illustrates a graph of predicted return loss in relation to frequency for an antenna assembly having cavities, as described herein, compared to an antenna assembly without cavities.

FIG. 11 illustrates a graph of predicted gain in relation to elevation angle for an antenna assembly having cavities, as described herein, compared to an antenna assembly without cavities. FIG. 12 illustrates a graph of predicted return loss in relation to frequency for an antenna assembly having cavities, as described herein, compared to an antenna assembly without cavities.

Referring to FIGS. 11 and 12, a numerical model of a high gain stripline antenna assembly in a 2×2 array designed to operate near 10 GHz was developed using a finite element method (FEM) solver to predict the performance. The antenna array with no cavities has a nominal gain of ~8.8 dBi and a 2:1 VSWR bandwidth of ~580 MHz. The antenna assembly with cavities has a nominal gain of ~9.9 dBi and a 2:1 VSWR bandwidth of ~1170 MHz. It has been found that the gain-bandwidth product of the antenna assembly is improved by a factor of more than 2.5 by using cavities.

As described herein, embodiments of the present disclosure provide stripline-based antenna assemblies that exhibit increased or otherwise improved gain and bandwidth.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. An antenna assembly comprising:

one or more dielectrics having a first surface and a second surface opposite from the first surface;

an antenna layer including one or more antenna elements disposed on the first surface of the one or more dielectrics, and one or more coplanar ground elements separated from the one or more antenna elements;

a stripline feed network disposed on or within the one or more dielectrics; and one or more cavities formed in the one or more dielectrics, wherein the one or more cavities are disposed below the one more antenna elements.

2. The antenna assembly of claim 1, further comprising one or more vias connecting the one or more coplanar ground elements to a ground plane disposed below the one or more dielectrics.

3. The antenna assembly of claim 1, further comprising a ground plane disposed below the one or more dielectrics.

4. The antenna assembly of claim 3, further comprising at least one additional dielectric disposed below the ground plane.

5. The antenna assembly of claim 1, wherein the one or more antenna elements comprise an inclusive slot formed therein.

6. The antenna assembly of claim 1, wherein the one or more cavities are between the first surface and the second surface.

7. The antenna assembly of claim 1, wherein the one or more antenna elements are above the one or more cavities.

8. The antenna assembly of claim 1, wherein at least a portion of the stripline feed network is disposed between the one or more antenna elements and the one or more cavities.

9. The antenna assembly of claim 1, wherein the one or more dielectrics comprise:

a first dielectric having the first surface;

a second dielectric secured to the first dielectric, wherein the second dielectric is disposed between the first dielectric and at least a portion of the stripline feed network; and a third dielectric comprising the one or more cavities and the second surface, wherein the at least a portion of the stripline feed network is disposed between the second dielectric and the third dielectric.

10. The antenna assembly of claim 1, wherein a first axial envelope of the one or more antenna elements is within a second axial envelope of the one or more cavities.

11. The antenna assembly of claim 1, wherein the one or more antenna elements comprise at least two antenna elements, and wherein the one or more cavities comprises at least two cavities.

12. A method of forming an antenna assembly, the method comprising:

providing one or more dielectrics having a first surface and a second surface opposite from the first surface;

disposing an antenna layer including one or more antenna elements on the first surface of the one or more dielectrics, and one or more coplanar ground elements separated from the one or more antenna elements;

disposing a stripline feed network on or within the one or more dielectrics; and forming one or more cavities in the one or more dielectrics below the one more antenna elements.

13. The method of claim 12, further comprising connecting the one or more coplanar ground elements to a ground plane disposed below the one or more dielectrics with one or more vias.

14. The method of claim 12, further comprising disposing a ground plane below the one or more dielectrics.

15. The method of claim 14, further comprising disposing at least one additional dielectric below the ground plane.

16. The method of claim 12, wherein said forming comprises forming the one or more cavities between the first surface and the second surface.

17. The method of claim 12, further comprising disposing at least a portion of the stripline feed network between the one or more antenna elements and the one or more cavities.

18. An antenna assembly comprising:

a first dielectric having a first surface;

an antenna layer disposed on the first surface, wherein the antenna layer comprises one or more antenna elements and one or more coplanar ground elements separated from the one or more antenna elements;

a second dielectric secured to the first dielectric;

a stripline feed network, wherein the second dielectric is disposed between the first dielectric and at least a portion of the of the stripline feed network;

a third dielectric comprising one or more cavities and a second surface opposite from the first surface, wherein the one or more cavities are disposed below the one more antenna elements, wherein a first axial envelope of the one or more antenna elements is within a second axial envelope of the one or more cavities, and wherein the at least a portion of the stripline feed network is disposed between the second dielectric and the third dielectric;

a ground plane secured to the second surface of the third dielectric;

one or more vias connecting the one or more coplanar ground elements to the ground plane; and at least one additional dielectric disposed below the ground plane.

19. An antenna assembly comprising:

one or more dielectrics having a first surface and a second surface opposite from the first surface;

an antenna layer including one or more antenna elements disposed on the first surface of the one or more dielectrics;

one or more cavities formed in the one or more dielectrics, wherein the one or more cavities are disposed below the one more antenna elements; and a stripline feed network disposed on or within the one or more dielectrics, wherein at least a portion of the stripline feed network is disposed between the one or more antenna elements and the one or more cavities.

20. An antenna assembly comprising:

a first dielectric having a first surface;

a second dielectric secured to the first dielectric;

a third dielectric having a second surface opposite from the first surface, and one or more cavities;

an antenna layer including one or more antenna elements disposed on the first surface of the first dielectric, wherein the one or more cavities are disposed below the one more antenna elements; and a stripline feed network, wherein the second dielectric is disposed between the first dielectric and at least a portion of the stripline feed network, and wherein the at least a portion of the stripline feed network is disposed between the second dielectric and the third dielectric.

* * * * *